US005248586A

United States Patent [19]

Nagaoka et al.

[11] Patent Number: 5,248,586

[45] Date of Patent: Sep. 28, 1993

[54] SILVER HALIDE COLOR PHOTOGRAPHIC MATERIALS

[75] Inventors: Yoko Nagaoka; Shigeto Hirabayashi, both of Hino, Japan

[73] Assignee: Konica Corporation, Tokyo, Japan

[21] Appl. No.: 954,796

[22] Filed: Sep. 30, 1992

Related U.S. Application Data

[63] Continuation of Ser. No. 676,769, Mar. 28, 1991, abandoned.

[30] Foreign Application Priority Data

Apr. 6, 1990 [JP] Japan ..... 2-92715

[51] Int. Cl.[5] ..... G03C 1/06

[52] U.S. Cl. ..... 430/551; 430/600; 430/607; 430/613

[58] Field of Search ..... 430/551, 600, 607, 613

[56] References Cited

U.S. PATENT DOCUMENTS

| | | | |
|---|---|---|---|
| 3,984,432 | 10/1976 | Piller et al. | 430/554 |
| 4,444,870 | 4/1984 | Hirano et al. | 430/554 |
| 4,480,028 | 10/1984 | Kato et al. | 430/544 |
| 4,748,105 | 5/1988 | Kadota et al. | 430/387 |

FOREIGN PATENT DOCUMENTS

| | | | |
|---|---|---|---|
| 200037 | 12/1982 | Japan | 430/505 |
| 42541 | 3/1984 | Japan | 430/505 |
| 57238 | 4/1984 | Japan | 430/505 |
| 90849 | 5/1984 | Japan | 430/544 |

*Primary Examiner*—Hoa Van Le

*Attorney, Agent, or Firm*—Frishauf, Holtz, Goodman & Woodward

[57] ABSTRACT

The improved silver halide color photographic material having as photographic constituent layers a blue-sensitive, a green-sensitive and a red-sensitive silver halide emulsion layer, as well as at least one non-light-sensitive hydrophilic colloidal layer on a support is characterized in that at least one of said photographic constituent layers contains at least one of the compounds represented by the following formula:

(where $R_1$ is a hydrogen atom or a monovaluent substituent; and $R_2$ is a group having a Hammett's value $\sigma_p$ of at least 0.2). This color photographic material is satisfactorily protected against deterioration in photographic performance such as reduced color or gamma, color contamination or increased fog even if it is exposed to formaldehyde and other deleterious gases for a long time of storage before it is subjected to color development and subsequent photographic processing.

14 Claims, No Drawings

SILVER HALIDE COLOR PHOTOGRAPHIC MATERIALS

This application is a continuation of application Ser. No. 07/676,769, filed Mar. 28, 1991 (abandoned).

BACKGROUND OF THE INVENTION

This invention rerates to silver halide color photographic materials, more particularly to silver halide color photographic materials that are protected against deterioration in photographic performance during storage that would otherwise occur on account of deleterious substances such as formaldehyde.

With a view to prevention the deterioration of photographic performance due to the reaction between photographic additives such as couplers and formaldehyde, it has been proposed to use compounds that react with formaldehyde to render it harmless (these compounds are hereinafter sometimes referred to as "aldehyde scavengers"). Examples of such compounds are described in U.S. Pat. Nos. 2,309,492, 2,895,827, JP-B-51-23908 (the term "JP-B" as used hereunder means an "examined Japanese patent publication"), JP-B-46-34675, JP-B-63-32378, JP-A-59-19945 (the term "JP-A" as used hereunder means an "unexamined published Japanese patent application"), JP-A-48-39029, JP-A-57-133450, JP-A-58-150950, U.S. Pat. Nos. 4,411,987, 3,811,891, 4,003,748, 4,414,309, and Research Disclosure, Vol. 101, No. 10133. However, the ability of these compounds to trap aldehyde gases is insufficient to guarantee that the deterioration in photographic performance which plagues silver halide color light-sensitive materials in commercial use today can be prevented in a satisfactory way merely by adding those compounds.

Further, if aldehyde scavengers are used in large amounts, the film characteristics of light-sensitive materials will deteriorate as typically evidenced by photographic coatings becoming vulnenerable. Since excessive use of aldehyde scavengers also causeadverse effects on the photographic performance of light-sensitive materials, there has been as inherent limit on the amount in which they can be added.

In recent years, various magenta couplers that have low reactivity, and hence high resistance, to deleterious gases such as formaldehyde have been reported. Indeed, two-equivalent couplers of the types described in U.S. Pat. Nos. 3,214,437, 3,253,924, 3,311,476, 3,419,391, 3,617,291, 3,926,631, 3,522,052, 3,227,554, and JP-A-56-126833 are far less sensitive to formaldehyde and other deleterious gases than four-equivalent couplers but they are by no means completely immune to the effects of those gases. Thus, even if couplers that are highly resistant to deleterious gases such as formaldehyde are used, a need still exists to use aldehyde scavengers.

SUMMARY OF THE INVENTION

The present invention has been achieved under these circumstances and has as an object providing a silver halide color photographic material that will not experience any deterioration in its photographic performance such as reduced color density or gamma, color contamiuation or increased fog even if it is exposed to formaldehyde and other deleterious gases for a long time of storage before it is subjected to color development and subsegvent photographic processing.

The present inventors conducted intensive studies in order to attain this object. As a result, it was found that said object could be achieved by a silver halide color photographic material comprising: a support and provided thereon a photographic constituent layer unit having a blue-sensitive silver halide emulsion layer, a green-sensitive silver halide emulsion layer, a red-sensitive silver halide emulsion layer, and a non-light-sensitive hydrophilic colloidal layer, wherein one of said layers contains a compound represented by the following formula (I):

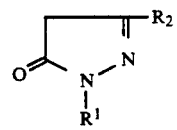

(I)

(where $R_1$ is a hydrogen atom or a monovalent substituent; and $R_2$ is a group having a Hammett's value $\sigma_p$ of at least 0.2).

DETAILED DESCRIPTION OF THE INVENTION

Examples of the substituent represented by $R_1$ in the general formula (I) include an alkyl group, an aryl group, a cycloalkyl group, an acyl group, a carbamoyl group, a sulfamoyl group, and an alkoxycarbonyl group. These groups may gave substituents such as carboxyl, sulfo, hydroxyl and amino groups.

The substituent represented by $R_2$ has a Hammett's value $\sigma_p$ of at least 0.2. The Hammett's value $\sigma_p$ of the substituent represented by $R_2$ is preferably 0.2–1.0, more preferably 0.3–0.7. If the Hammett's value $\sigma_p$ of $R_2$ is lower than 0.2, the compound (I) will enter into a coupling reaction with quinonediimine which is the oxidation product of a color developing agent and the consumption of quinonediimine in the light-sensitive material will lead to a lower color density. At the same time, the dye produced as a result of coupling between the compound (I) and quinonedimine will remain in the light-sensitive material to cause color contamination or staining. Furthermore, if the dye dissolves out into the color developing solution, its accumulation can cause staining, particularly in a processing line that is adapted for low pollution by using reduced amounts of replenishers.

If, on the other hand, the Hammett's value $\sigma_p$ of $R_2$ is extremely higher than 1.0, it is not highly reactive with quinonediimine and the color density is low enough to cause little effect on the photographic performance of the light-sensitive material. However, the reactivity of $R_2$ with deleterious substances substances such as formaldehyde is also low and is not capable of achieving the object of the present invention in an effective way.

It was quite surprising that 5-pyrazolone compounds that had low reactivity with quinonediimine and which yet possessed reactivity with formaldehyde and other deleterious substances could be obtained by adjusting the Hammett's value $\sigma_p$ of the substituent in 3-position to a level not smaller than 0.2.

Examples of the substituent represented by $R_2$ which has a Hammett's value $\sigma_p$ of at least 0.2 include cyano, carbamoyl, carboxyl, alkoxycarbonyl, acyl, haloalkyl, nitro, sulfamoyl and alkylsulfonyl groups.

The following are specific, but non-limiting, examples of the compound represented by the general formula (I):

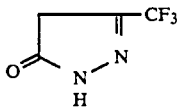
(1)
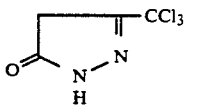
(2)
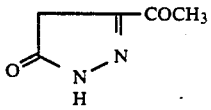
(3)
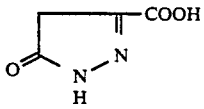
(4)
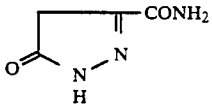
(5)
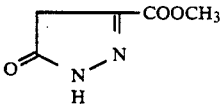
(6)
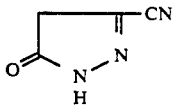
(7)
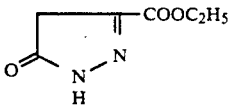
(8)
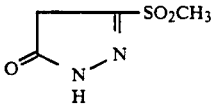
(9)
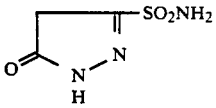
(10)
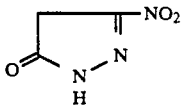
(11)
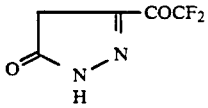
(12)
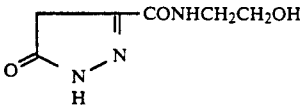
(13)
-continued
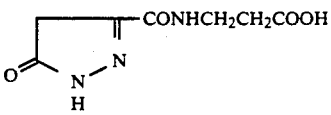
(14)
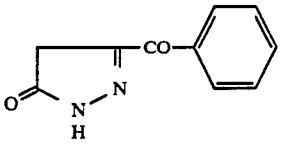
(15)
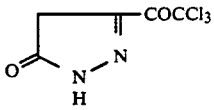
(16)
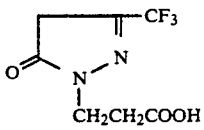
(17)
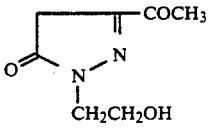
(18)
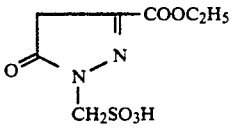
(19)
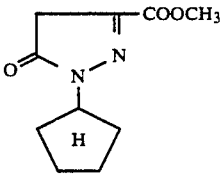
(20)
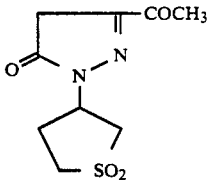
(21)
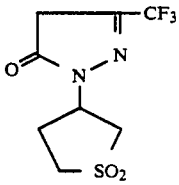
(22)
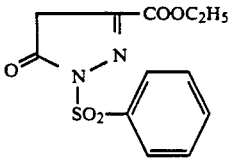
(23)

-continued
(24)
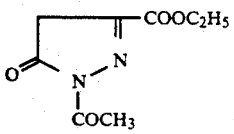
(25)
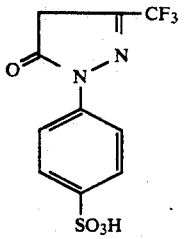
(26)
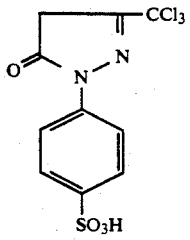
(27)
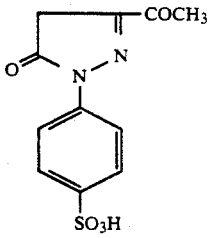
(28)
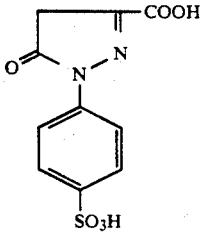
(29)
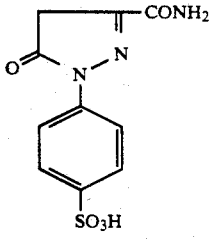
(30)
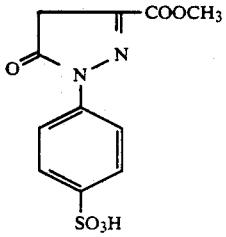
-continued
(31)
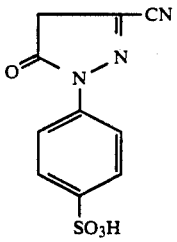
(32)
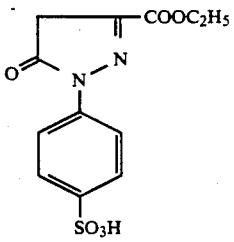
(33)
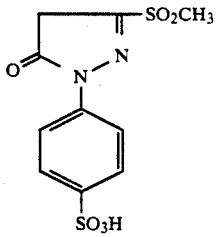
(34)
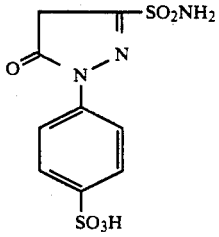
(35)
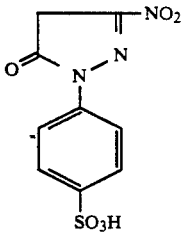
(36)
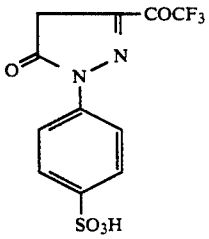

-continued
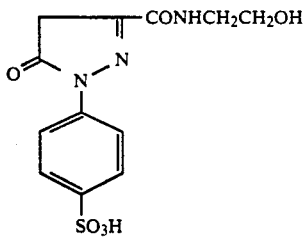
(37)
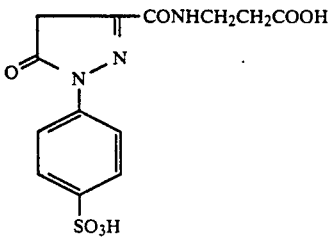
(38)
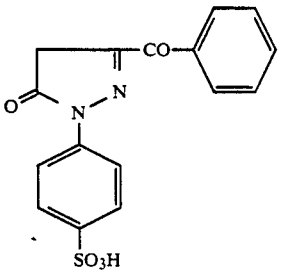
(39)
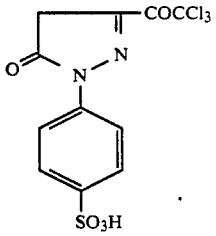
(40)
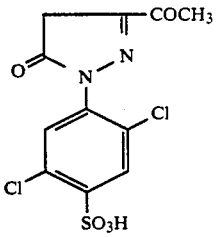
(41)
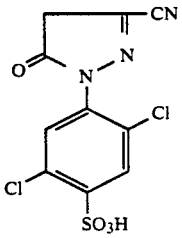
(42)
-continued
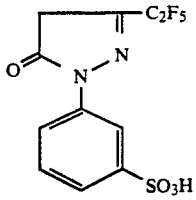
(43)
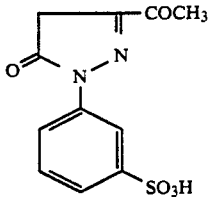
(44)
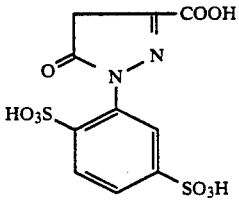
(45)
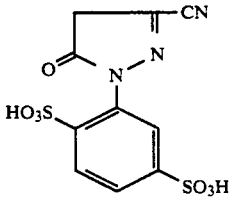
(46)
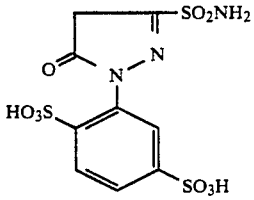
(47)
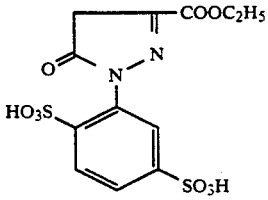
(48)
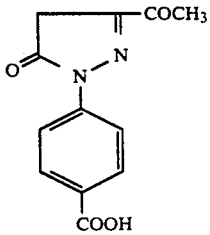
(49)

-continued (50)

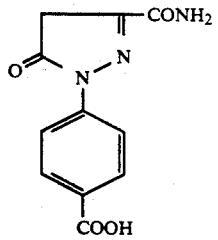

(51)

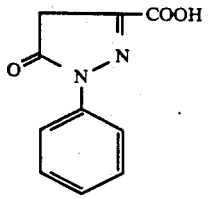

(52)

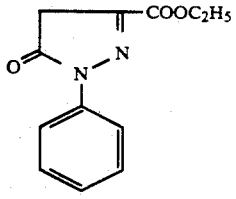

(53)

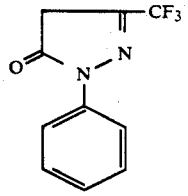

(54)

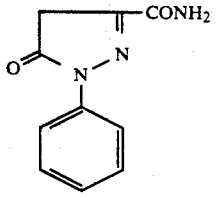

(55)

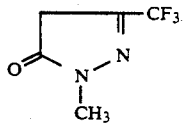

(56)

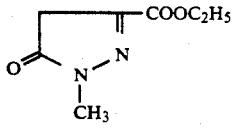

(57)

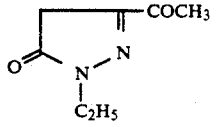

(58)

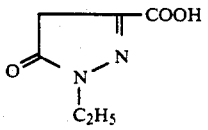

-continued (59)

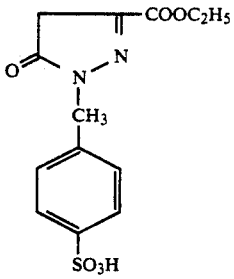

(60)

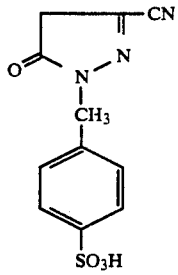

Many of the compounds represented by the general formula (I) are commercially available and, if necessary, they can be easily synthesized in accordance with the methods described in JP-A-51-77327, 62-273527 and British Patent No. 585,780.

The aldehyde acavengers to be used in the present invention are preferably incorporated in a layer that contains a magenta coupler and/or in an overlying photographic constituent layer of the silver halide color photographic material. It is effective and most preferred for the scavengers to be incorporated in the layer that is the remotest from the support, for example, in a protective layer.

The aldehyde scavengers may be used either singly or in combination with themselves or with other aldehyde scavengers than the compounds (I).

The term "photographic constituent layer unit" as used herein includes not only light-sensitive silver halide emulsion layers that are optically or chemically sensitized but also other layers that comprise a light-sensitive material and that have no light sensitivity such as intermediate layers, uv absorbing layers, yellow filter layers, protective layers and any other auxiliary layers.

In order to add and incorporate the aldehyde scavengers, or compounds (I), in the photographic layers, they may be dissolved in respective coating solutions with the aid of suitable solvents such as water and methanol. The aldehyde scavengers may be added at any stage of the process of manufacture. The aldehyde scavengers are desirably added just before application of coating solutions if they are to be incorporated in silver halide emulsion layers.

The aldehyde scavengers are preferably added in amounts of 0.01–5.0 g per square meter of the color photographic material and the most preferred results can be attained by adding them in amounts of 0.1–2.0 g.

The silver halide emulsion to be used in the present invention may incorporate any types of silver halides such as silver bromide, silver iodobromide, silver iodochloride, silver chlorobromide and silver chloride that are commonly employed in silver halide emulsions.

The silver halide grains to be used in silver halide emulsions may have a homogeneous silver halide composition in their interior, or they may have a core/shell structure in which the interior of grains has a different silver halide composition than the surface layers. The silver halide grains may be of a type that forms a latent image predominantly on the surface or of a type that forms a latent image predominantly in the interior.

The silver halide emulsions may have any grain size distribution. Emulsions having a broad grain size distribution (called "polydispersed emulsions") may be used or, alternatively, emulsions having a narrow grain size distribution (named "monodispersed emulsions") may be used either singly or as admixtures. If desired, a polydispersed emulsion may be used in combination with a monodispersed emulsion.

Separately prepared two or more silver halide emulsions may be used as admixtures.

The emulsions may be chemically sensitized in the usual manner or they may be optically sensitized with spectral sensitizers to have sensitivity in a desired wavelength region.

Antifoggants, stabilizers and other additives may be added to silver halide emulsions. Gelatin is advantageously used as a binder for the emulsions.

Emulsion layers and other hydrophilic colloidal layers can be hardened. If desired, plasticizers or dispersions (latices) of water-insoluble or slightly water-soluble synthetic polymers may be incorporated in those layers.

Couplers are used in the emulsion layers of the color photographic material of the present invention. Further, competitive couplers that are capable of color correction, as well as compounds that couple with the oxidation product of developing agents to release photographically useful fragments such as a development accelerator, a bleach accelerator, a developing agent, a silver halide solvent, a toning agent, a hardener, a foggant, an antifoggant, a chemical sensitizer, a spectral sensitizer and a desensitizer may be employed.

Known acylacetanilide compounds are preferably used as yellow-dye forming couplers and among them benzoylacetanilide and pivaloylacetanilide compounds are particularly advantageous.

Compounds that can be used as magenta-dye forming couplers include 5-pyrazolone, pyrazoloazole, pyrazolobenzimidazole, open-chain acylacetonitrile and indazole compounds. Particularly significant results are attained in the present invention by using four-equivalent 5-pyrazolone compounds.

Phenolic or naphtholic compounds are generally used as cyan-dye forming couplers.

The light-sensitive material of the present invention may be provided with auxiliary layers such as a filter layer, an anti-halo layer and an anti-irradiation layer. Dyes that dissolve out of the light-sensitive material during development or that are bleached may be incorporated in those auxiliary layers and/or emulsion layers.

The light-sensitive material of the present invention may also contain a matting agent, a lubricant, an image stabilizer, a uv absorber, an optical brightening agent, a surfactant, a development accelerator, a development retarder or a bleach accelerator.

Supports that can be used in the present invention include polyethylene-laminated paper, a polyethylene terephthalate film, baryta paper, triacetyl cellulose, etc.

In order to produce dye image, the color photographic material of the present invention is first exposed imagewise and then subjected to known procedures of color photographic processing.

The following examples are provided for the purpose of further illustrating the present invention but are in no way to be taken as limiting. In these examples, the amounts of all components in the prepared samples of silver halide photographic material are in grams per square meter unless otherwise noted. The amounts of silver halide and colloidal silver are calculated for silver, and the amounts of spectral sensitizers are in moles per mole of silver.

EXAMPLE 1

Layers having the compositions set forth below were coated onto a triacetyl cellulose film base, with the first layer being formed the closest to the base, whereby a sample of multi-layered color photographic material (Sample 1) was prepared.

| | |
|---|---|
| First layer: Anti-halo layer (HC) | |
| Black colloidal silver | 0.15 |
| UV absorber (UV-1) | 0.20 |
| Colored cyan coupler (CC-1) | 0.02 |
| High-boiling solvent (Oil-1) | 0.20 |
| High-boiling solvent (Oil-2) | 0.20 |
| Gelatin | 1.6 |
| Second layer: Intermediate layer (IL-2) | |
| Gelatin | 1.3 |
| Third layer: Less red-sensitive emulsion layer (R-L) | |
| Silver iodobromide emulsion (Em-1) | 0.4 |
| Silver iodobromide emulsion (Em-2) | 0.3 |
| Spectral sensitizer (S-1) | $3.2 \times 10^{-4}$ |
| Spectral sensitizer (S-2) | $3.2 \times 10^{-4}$ |
| Spectral sensitizer (S-3) | $0.2 \times 10^{-4}$ |
| Cyan coupler (C-1) | 0.50 |
| Cyan coupler (C-2) | 0.13 |
| Colored cyan coupler (CC-1) | 0.07 |
| Dir compound (D-1) | 0.006 |
| DIR compound (D-2) | 0.01 |
| High-boiling solvent (Oil-1) | 0.55 |
| Gelatin | 1.0 |
| Fourth layer: Highly red-sensitive emulsion layer (R-H) | |
| Silver iodobromide emulsion (Em-3) | 0.9 |
| Spectral sensitizer (S-1) | $1.7 \times 10^{-4}$ |
| Spectral sensitizer (S-2) | $1.6 \times 10^{-4}$ |
| Spectral sensitizer (S-3) | $0.1 \times 10^{-4}$ |
| Cyan coupler (C-2) | 0.23 |
| Colored cyan coupler (CC-1) | 0.03 |
| DIR compound (D-2) | 0.02 |
| High-boiling solvent (Oil-1) | 0.25 |
| Gelatin | 1.0 |
| Fifth layer: Intermediate layer (IL-2) | |
| Gelatin | 0.8 |
| Sixth layer: Less green-sensitive emulsion layer (G-L) | |
| Silver iodobromide emulsion (Em-1) | 0.6 |
| Silver iodobromide emulsion (Em-2) | 0.2 |
| Spectral sensitizer (S-4) | $6.7 \times 10^{-4}$ |
| Spectral sensitizer (S-5) | $0.8 \times 10^{-4}$ |
| Magenta coupler (M-1) | 0.60 |
| Colored magenta coupler (CM-1) | 0.10 |
| DIR compound (D-3) | 0.02 |
| High-boiling solvent (Oil-2) | 0.70 |
| Gelatin | 1.0 |
| Seventh layer: Highly green-sensitive emulsion layer (G-H) | |
| Silver iodobromide emulsion (Em-3) | 0.9 |
| Spectral sensitizer (S-6) | $1.1 \times 10^{-4}$ |
| Spectral sensitizer (S-7) | $2.0 \times 10^{-4}$ |
| Spectral sensitizer (S-8) | $0.3 \times 10^{-4}$ |
| Magenta coupler (M-1) | 0.15 |
| Colored magenta coupler (CM-1) | 0.04 |
| DIR compound (D-3) | 0.004 |
| High-boiling solvent (Oil-2) | 0.35 |
| Gelatin | 1.0 |
| Eighth layer: Yellow filter layer (YC) | |
| Yellow colloidal silver | 0.1 |
| Additive (SC-1) | 0.1 |
| High-boiling solvent (Oil-2) | 0.15 |

-continued

| | |
|---|---|
| Gelatin | 1.0 |
| Ninth layer: Less blue-sensitive emulsion layer (B-L) | |
| Silver iodobromide emulsion (Em-1) | 0.25 |
| Silver iodobromide emulsion (Em-2) | 0.25 |
| Spectral sensitizer (S-9) | $5.8 \times 10^{-4}$ |
| Yellow coupler (Y-1) | 0.60 |
| Yellow coupler (Y-2) | 0.32 |
| DIR compound (D-1) | 0.003 |
| DIR compound (D-2) | 0.006 |
| High-boiling solvent (Oil-2) | 0.18 |
| Gelatin | 1.3 |
| Tenth layer: Highly blue-sensitive emulsion layer (B-H) | |
| Silver iodobromide emulsion (Em-4) | 0.5 |
| Spectral sensitizer (S-10) | $3.0 \times 10^{-4}$ |
| Spectral sensitizer (S-11) | $1.2 \times 10^{-4}$ |
| Yellow coupler (Y-1) | 0.18 |
| Yellow coupler (Y-2) | 0.10 |
| High-boiling solvent (Oil-2) | 0.05 |
| Gelatin | 1.0 |
| Eleventh layer: First protective layer (PRO-1) | |
| Silver iodobromide emulsion (Em-5) | 0.3 |
| UV absorber (UV-1) | 0.07 |
| UV absorber (UV-2) | 0.1 |
| High-boiling solvent (Oil-1) | 0.07 |
| High-boiling solvent (Oil-3) | 0.07 |
| Gelatin | 0.8 |
| Twelfth layer: Second protective layer (PRO-2) | |
| Alkali-soluble matting agent (average particle size, 2 μm) | 0.13 |
| Polymethyl methacrylate (average particle size, 3 μm) | 0.02 |

-continued

| | |
|---|---|
| Gelatin | 0.5 |

In addition to the components listed above, a coating aid (SU-2), a dispersion aid (SU-1), a hardener (H-1), and dyes (AI-1) and (AI-2) were added as appropriate to the respective layers.

The emulsions used in sample 1 had the following characteristics. Each of them was a monodispersed emulsion with high iodine content in the interior.

Em-1:
average AgI content, 7.5 mol %
average grain size, 0.55 μm
grain shape, octahedral Em-2:
average AgI content, 2.5 mol %
average grain size, 0.36 μm
grain shape, octahedral Em-3:
average AgI content, 8.0 mol %
average grain size, 0.84 μm
grain shape, octahedral Em-4:
average AgI content, 8.5 mol %
average grain size, 1.02 μm
grain shape, octahedral Em-5:
average AgI content, 2.0 mol %
average grain size, 0.08 μm

C-1

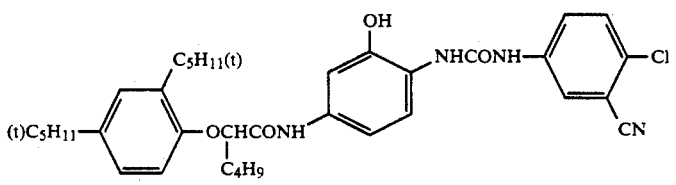

C-2

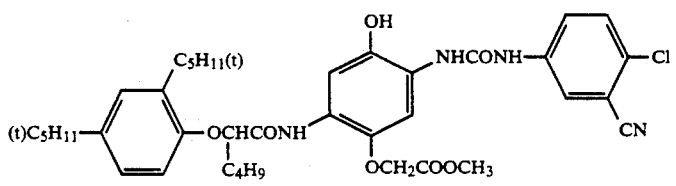

M-1

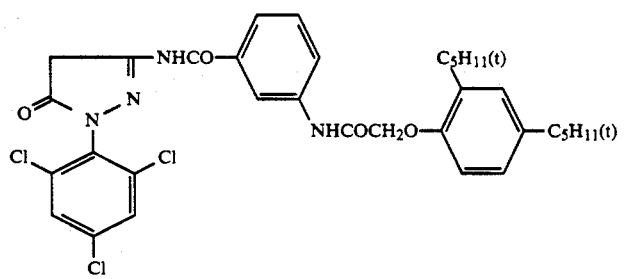

-continued
Y-1
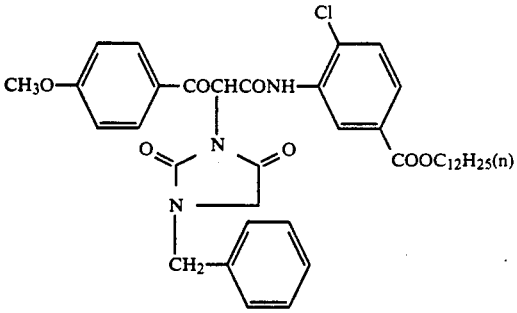
(Y-2)
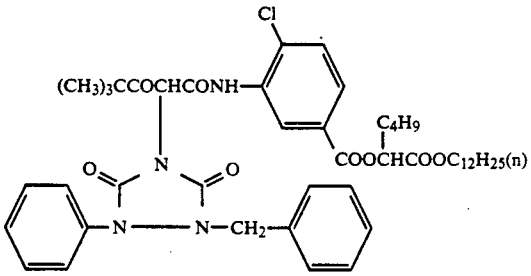
CC-1
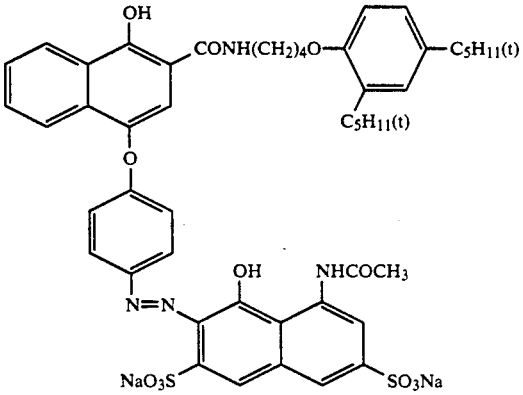
CM-1
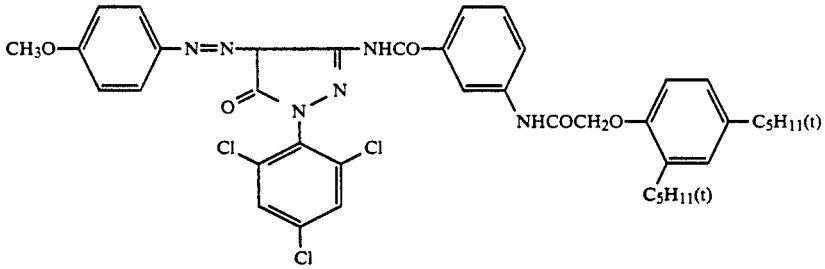
(D-1)
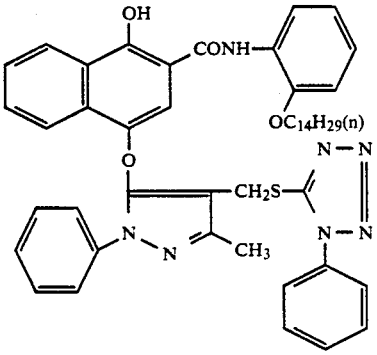

-continued
D-2
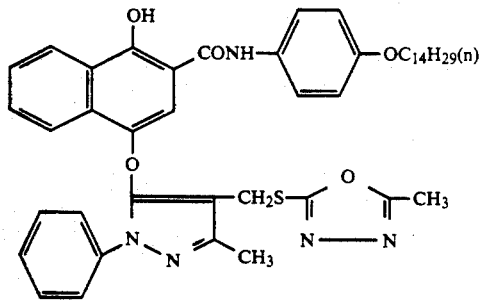
D-3
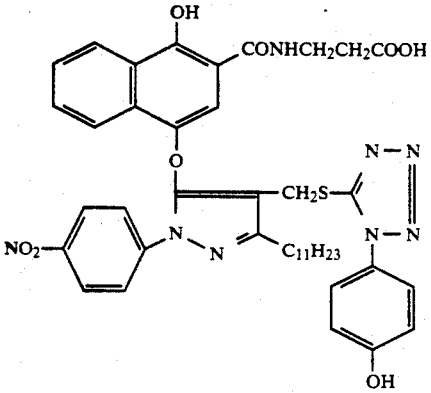
UV-1
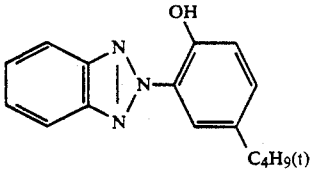
UV-2
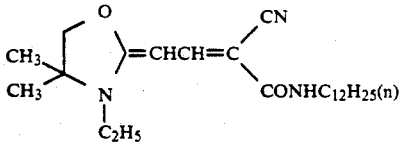
S-1
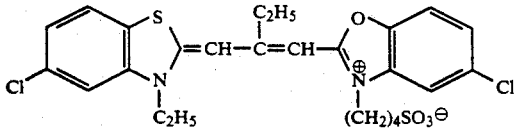
S-2
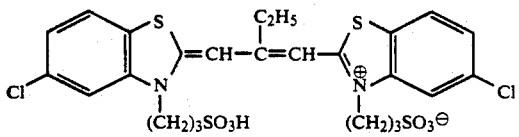
S-3
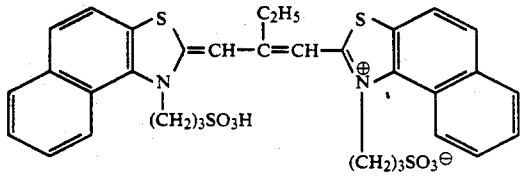

-continued
S-4
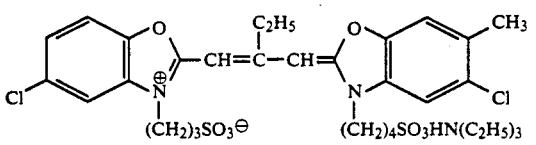
S-5
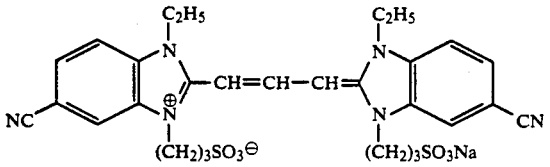
S-6
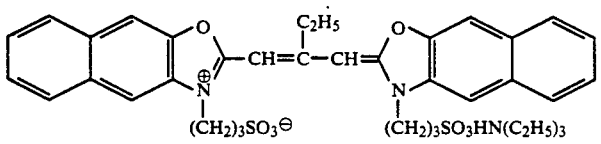
S-7
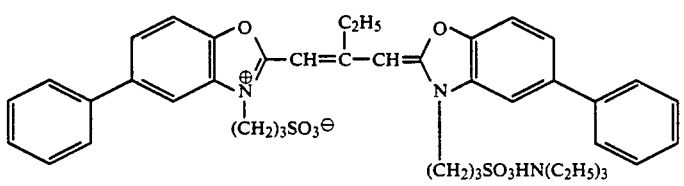
S-8
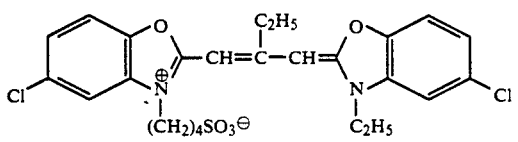
S-9
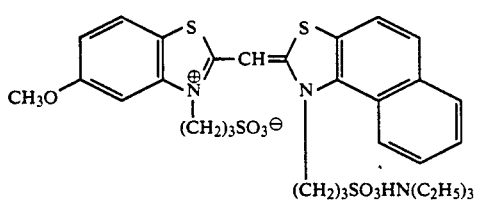
S-10
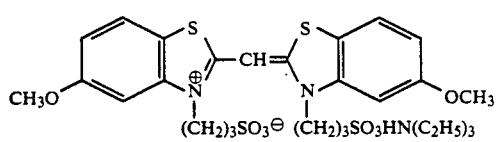
S-11
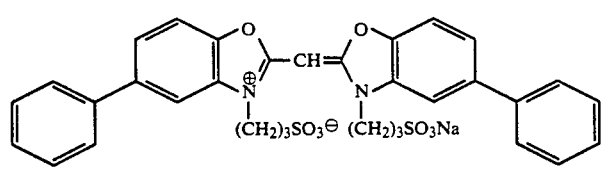
AI-1
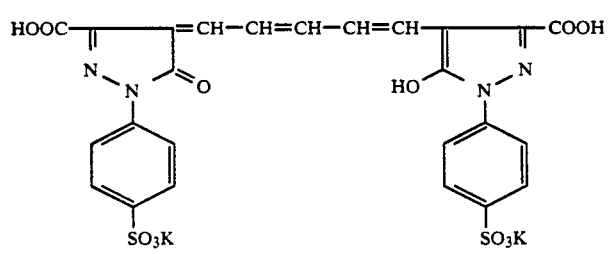

-continued

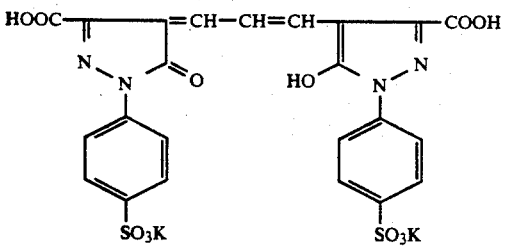

AI-2

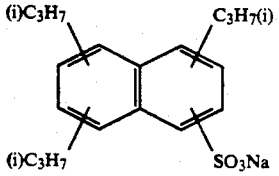

SU-1

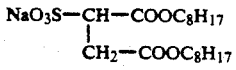

SU-2

2:3 mixture of

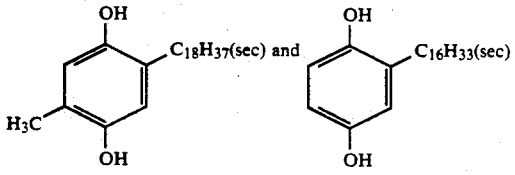

SC-1

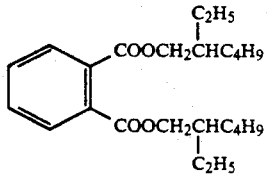

Oil-1

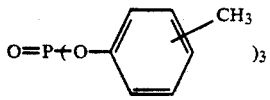

Oil-2

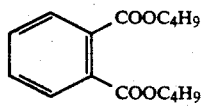

Oil-3

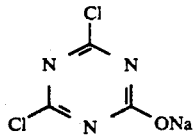

H-1

Additional samples 2–24 were prepared in the same manner as in sample 1 in Example 1 except that aldehyde scavengers (see Table 1 below) were added to the eleventh layer (PRO-1) each in an amount of $3\times10^{-3}$ moles/$m^2$.

The samples thus prepared were exposed through an optical wedge in the usual manner and subjected to the following treatments.

Treatment 1

A 35% aqueous solution of glycerin (300 cc) was charge into a gas-tight container and each of the sample was held in air equilibrated with glycerin in the container at 30° C. for 3 days.

Treatment 2

A 35% aqueous solution of glycerin (300 cc) containing 6 cc of a 35% aqueous formaldehyde solution was charged into a gastight container and each of the samples was held in air equilibrated with glycerin+formaldehyde in the container at 30° C. for 3 days.

The samples subjected to treatment 1 or 2 were then processed for color photography in accordance with the scheme shown below.

| Processing scheme (38° C.) | |
|---|---|
| Color development | 3 min and 15 sec |

-continued

| Processing scheme (38° C.) | |
|---|---|
| Bleaching | 4 min and 20 sec |
| Fixing | 6 min and 30 sec |
| Washing | 3 min and 15 sec |
| Stabilizing | 1 min and 30 sec |
| Drying | |

The developing, bleaching, fixing and stabilizing solutions were prepared according to the following formulas.

| | |
|---|---|
| Color developing solution | |
| 4-Amino-8-methyl-N-ethyl-N-(β-hydroxyethyl)aniline sulfate | 4.75 g |
| Anhydrous sodium sulfite | 4.25 g |
| Hydroxylamine hemisulfate | 2.0 g |
| Anhydrous potassium carbonate | 37.5 g |
| Potassium iodide | 1.9 mg |
| Sodium bromide | 1.3 g |
| Nitrilotriacetic acid trisodium salt (monohydrate) | 2.5 g |
| Potassium hydroxide | 1.0 g |
| Water to make | 1,000 ml |
| pH adjusted to | 10.02 |
| Bleaching solution | |
| Ethylenediaminetetraacetic acid iron (III) ammonium salt | 100.0 g |
| Ethylenediaminetetraacetic acid diammonium salt | 10.0 g |
| Ammonium bromide | 150.0 g |
| Glacial acetic acid | 10.0 g |
| Water to make | 1,000 ml |
| pH adjusted to 6.0 with aqueous ammonia | |
| Fixing solution | |
| Ammonium thiosulfate | 175.0 g |
| Anhydrous sodium saulfite | 8.6 g |
| Sodium metasulfite | 2.3 g |
| water to make | 1,000 ml |
| pH adjusted to 6.0 with acetic acid | |
| Stabilizing solution | |
| Formaldehyde (37% aq. sol.) | 1.5 ml |
| Konidax (Konica Corp.) | 7.5 ml |
| Water to make | 1,000 ml |

After the processing for color photography, all samples were measured for a maximum density of magenta color with an optical densitometer PDA-65 (Konica Corp.) using green light, and the change in the maximum density area of magenta color due to exposure to formaldehyde gas was determined on the basis of the results with treatments 1 and 2. The maximum density of magenta color was calculated by subtracting the green density of the unexposed area from the maximum density of green image. The results of measurements and the $\sigma_p$ values of $R_2$ in the compounds used are shown in Table 1 below.

TABLE 1

| Sample No. | Aldehyde scavenger: Compound | Aldehyde scavenger: $\sigma_p$ | Maximum density of magenta color: Treatment 1 | Maximum density of magenta color: Treatment 2 | Percent change | Remarks |
|---|---|---|---|---|---|---|
| 1 | | | 2.40 | 0.89 | 37 | Comparison |
| 2 | HS-1 | | 2.42 | 1.45 | 60 | |
| 3 | HS-2 | −0.84 | 2.13 | 1.92 | 90 | |
| 4 | HS-3 | −0.20 | 2.22 | 1.87 | 84 | |
| 5 | (1) | 0.54 | 2.42 | 2.27 | 94 | |
| 6 | (3) | 0.50 | 2.41 | 2.24 | 93 | |
| 7 | (4) | 0.41 | 2.40 | 2.21 | 92 | |
| 8 | (5) | 0.36 | 2.38 | 2.17 | 91 | |
| 9 | (7) | 0.66 | 2.40 | 2.16 | 90 | Invention |
| 10 | (8) | 0.45 | 2.42 | 2.27 | 94 | |
| 11 | (12) | 0.93 | 2.40 | 2.04 | 85 | |
| 12 | (15) | 0.36 | 2.35 | 2.16 | 92 | |
| 13 | (18) | 0.50 | 2.41 | 2.22 | 92 | |
| 14 | (19) | 0.45 | 2.42 | 2.20 | 91 | |
| 15 | (22) | 0.54 | 2.43 | 2.24 | 92 | |
| 16 | (23) | 0.45 | 2.42 | 2.23 | 92 | |
| 17 | (25) | 0.54 | 2.42 | 2.20 | 91 | |
| 18 | (29) | 0.36 | 2.39 | 2.15 | 90 | |
| 19 | (33) | 0.68 | 2.39 | 2.10 | 88 | Invention |
| 20 | (34) | 0.62 | 2.40 | 2.16 | 90 | |
| 21 | (48) | 0.45 | 2.42 | 2.23 | 92 | |
| 22 | (49) | 0.50 | 2.41 | 2.22 | 92 | |
| 23 | (54) | 0.36 | 2.37 | 2.13 | 90 | |
| 24 | (55) | 0.54 | 2.41 | 2.22 | 92 | |

HS-1 (Comparative aldehyde scavenger):

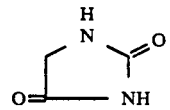

HS-2 (Comparative aldehyde scavenger):

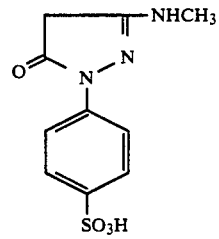

HS-3 (Comparative aldehyde scavenger):

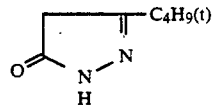

As is clear from Table 1, sample 2 which used HS-1 as a comparative aldehyde scavenger experienced a marked drop in the maximum density of magenta color as a result of treatment 2. Further, samples 3 and 4 which used HS-2 and HS-3 in which the substituents $R_2$ had Hammett's values $\sigma_p$ of less than 0.2 already exhibited low maximum densities of magenta color in treatment 1, indicating the adverse effects of HS-2 and HS-3 on color formation. In contrast, the compounds of the present invention used in samples 5–24 were in no way deleterious to color formation and these samples experienced only a small decrease in the maximum density of magenta color as a result of treatment 2. It should also be mentioned that samples 5–24 the present invention experienced no deterioration in photographic performance such as lower gamma, color contamination or increased fog.

EXAMPLE 2

Additional samples were prepared as in Example 1 except that magenta coupler M-1 used in the sixth and seventh layers was replaced by M-2 or M-3 identified below. When those samples were subjected to the same tests as in Example 1, the effectiveness of the present invention was verified.

M-2

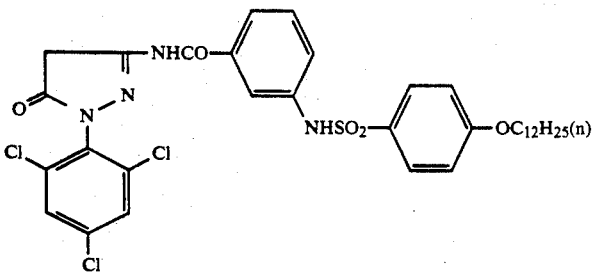

M-3

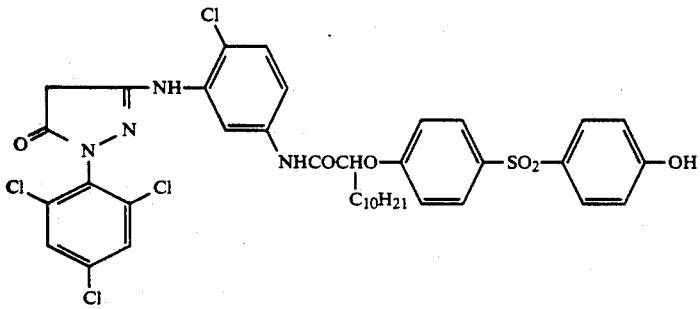

The silver halide color photographic material of the present invention will not experience any deterioration in its photographic performance such as reduced color density or gamma, color contamination or increased fog even if it is exposed to formaldehyde and other deleterious gases for a long time of storage before it is subjected to color development and subsegvent photographic processing.

What is claimed is:

1. A silver halide color photographic material comprising: a support and provided thereon a photographic constituent layer unit having a blue-sensitive silver halide emulsion layer, a green-sensitive silver halide emulsion layer, a red-sensitive silver halide emulsion layer and a non-light-sensitive hydrophilic colloidal layer, wherein said non-light-sensitive hydrophilic colloidal layer contains a compound represented by the following formula (I):

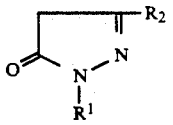

(I)

(where $R_1$ is a hydrogen atom or a monovalent substituent; and $R_2$ is a group having a Hammett's value $\sigma_p$ of at least 0.2).

2. The photographic material of claim 1 wherein $R_2$ is a group having a Hammett's value of 0.2–1.0.

3. The photographic material of claim 1 wherein $R_2$ is a group having a Hammett's value $\sigma_p$ of 0.3–0.7.

4. The photographic material of claim 1 wherein $R_2$ is at least one member selected from among a cyano group, a carbamoyl group, a carboxyl group, an alkoxycarbonyl group, an acyl group, a haloalkyl group, a nitro group, a sulfamoyl group and an alkylsulfonyl group.

5. The photographic material of claim 1 wherein said compound represented by the general formula (I) is incorporated in one of said layers containing a magenta coupler and/or in an overlying photographic constituent layer to said magenta coupler containing layer with respect to said support.

6. The photographic material of claim 1 wherein said compound represented by the general formula (I) is incorporated in the layer which is the remotest from the support.

7. The photographic material of claim 1 wherein said compound represented by the general formula (I) is contained in an amount of 0.01–5.0 g per square meter of the photographic material.

8. The photographic material of claim 1 wherein said compound represented by the general formula (I) is contained in an amount of 0.1–2.0 g per square meter of the photographic material.

9. The photographic material of claim 1 which contains a benzoylacetanilide or pivaloylacetanilide compound as a yellow dye forming coupler.

10. The photographic material of claim 1 which contains a four equivalent 5-pyrazolone compound as a magenta dye forming coupler.

11. The photographic material of claim 1 wherein said compound represented by the general formula (I) is one of compounds 1–60 as defined below:

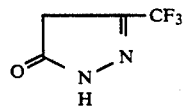

(1)

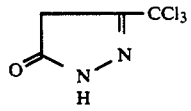

(2)

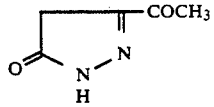

(3)

-continued
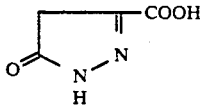
(4)
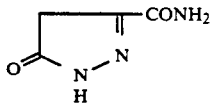
(5)
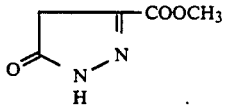
(6)
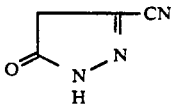
(7)
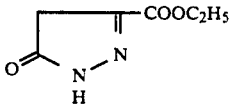
(8)
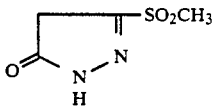
(9)
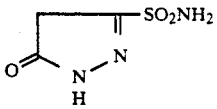
(10)
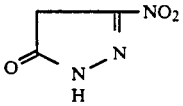
(11)
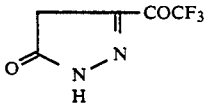
(12)
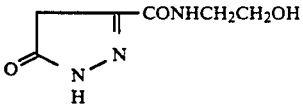
(13)
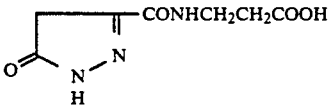
(14)
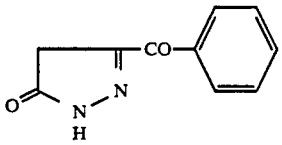
(15)
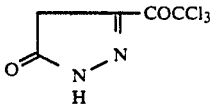
(16)
-continued
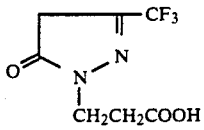
(17)
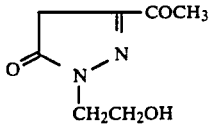
(18)
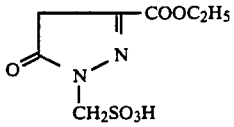
(19)
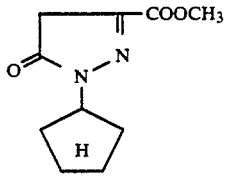
(20)
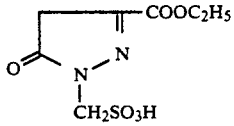
(21)
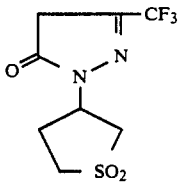
(22)
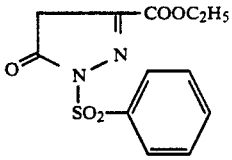
(23)
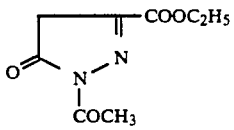
(24)
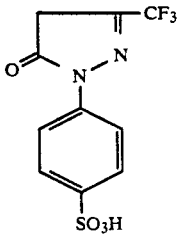
(25)

-continued
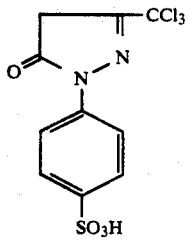
(26)
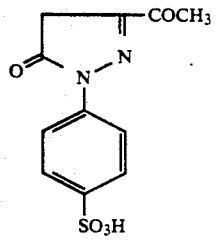
(27)
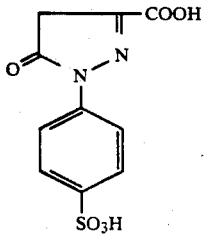
(28)
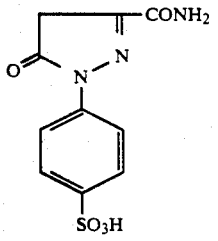
(29)
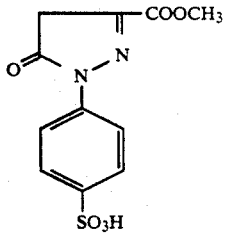
(30)
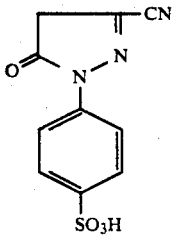
(31)
-continued
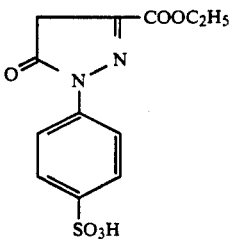
(32)
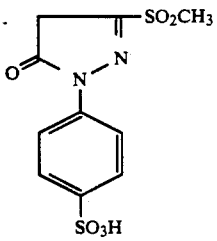
(33)
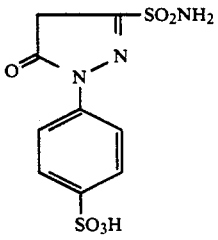
(34)
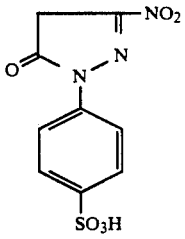
(35)
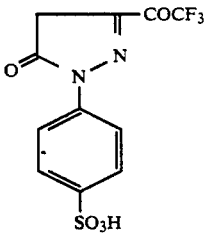
(36)
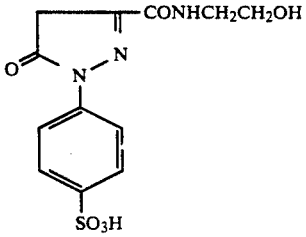
(37)

-continued
(38)
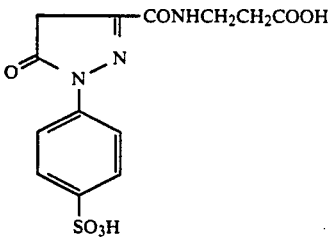
(39)
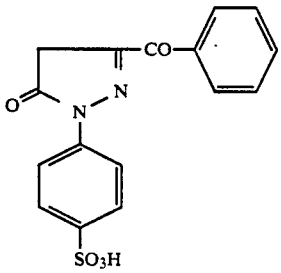
(40)
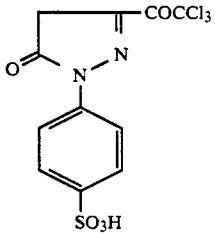
(41)
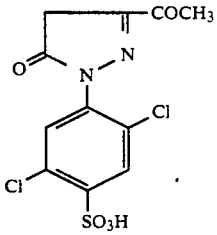
(42)
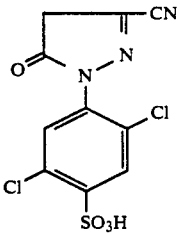
(43)
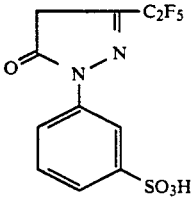
-continued
(44)
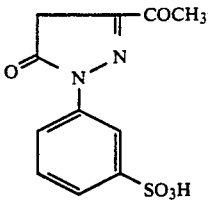
(45)
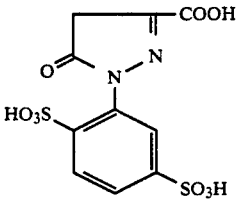
(46)
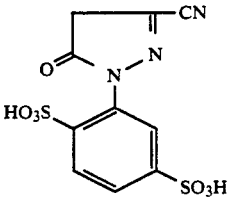
(47)
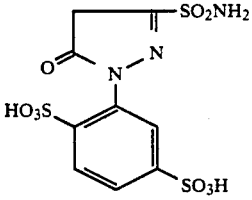
(48)
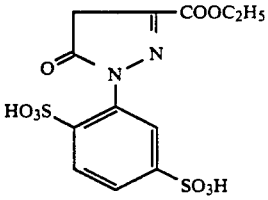
(49)
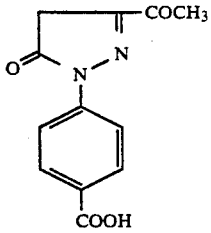
(50)
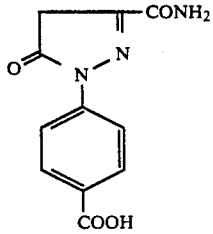

-continued (51)

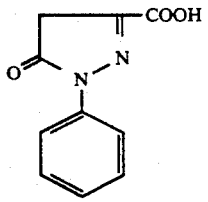

(52)

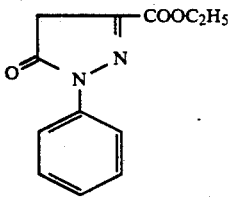

(53)

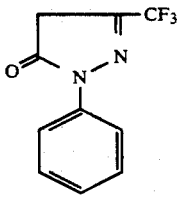

(54)

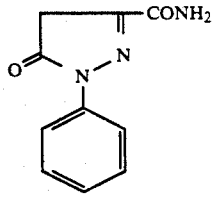

(55)

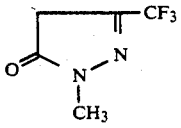

(56)

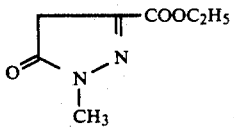

-continued (57)

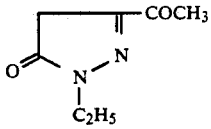

(58)

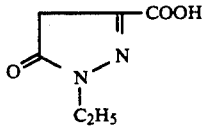

(59)

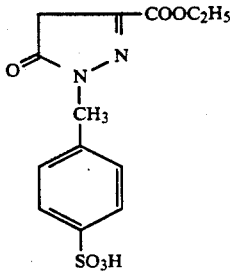

(60)

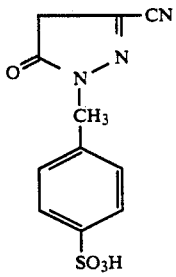

12. The photographic material of claim 11 wherein said compound of formula (I) is contained in the photographic material in an amount of 0.01–5.0 g per square meter of the photographic material.

13. The photographic material of claim 12 wherein said compound of formula (I) is incorporated in the layer which is the remotest from the support.

14. The photographic material of claim 12 wherein said compound of the formula (I) is incorporated in one of said layers containing a magenta coupler and/or in an overlying photographic constituent layer to said magenta coupler containing layer with respect to said support.

* * * * *